US006526000B1

(12) United States Patent
Charneski

(10) Patent No.: US 6,526,000 B1
(45) Date of Patent: Feb. 25, 2003

(54) PATTERN DISPLAY

(75) Inventor: James Charneski, Fishkill, NY (US)

(73) Assignees: Philip D. Guercio, Hyde Park, NY (US); Joseph B. Taphorn, Poughkeepsie, NY (US)

( * ) Notice: Subject to any disclaimer, the term of this patent is extended or adjusted under 35 U.S.C. 154(b) by 0 days.

(21) Appl. No.: 08/395,119

(22) Filed: Feb. 27, 1995

(51) Int. Cl.[7] ..... G04C 17/00; G09G 3/04; G09G 3/06; G09G 3/20

(52) U.S. Cl. ..... 368/239; 345/33; 345/44; 345/55

(58) Field of Search ..... 345/33, 39, 55, 345/34, 38, 44–46, 50; 368/223–242, 82–84

(56) References Cited

U.S. PATENT DOCUMENTS 1,231,821 A * 7/1917 Walton ..... 345/33
3,638,215 A * 1/1972 Payne ..... 345/33
3,793,629 A * 2/1974 Sharpless ..... 345/33
3,981,003 A * 9/1976 Huguenin ..... 345/33
4,039,890 A * 8/1977 Bailey et al. ..... 345/33
4,194,352 A * 3/1980 Terzian ..... 368/239
4,365,244 A * 12/1982 Gillessen et al. ..... 345/33
D308,829 S * 6/1990 Gaultier et al. ..... D10/15

* cited by examiner

*Primary Examiner*—Vit Miska
(74) *Attorney, Agent, or Firm*—Joseph B. Taphorn

(57) ABSTRACT

A display arrangement for a digital wrist watch LED face or a computer cathode ray tube face provides for ornamental and coded displays. In the arrangement, the digital information is repeated in juxtaposed rows repeating the same digits in columnar fashion, the digits sharing above and below border elements to form continous vertical patterns in side by side spaced relationships.

16 Claims, 5 Drawing Sheets

PATTERN DISPLAY

INTRODUCTION

1. Field of the Invention

This invention relates to adjustable displays such as the time on a watch face, and more particularly, to an adjustable display wherein the displayed symbol is repeated in juxtaposed rows on a matrix.

2. Background of the Invention

Digital watch faces are an example of adjustable displays. On some watches faces, a time digit is indicated by selectively lighting various ones of the elements of a framework of light emitting elements which will indicate the shape of a numeral.

3. Prior Art

The Prior Art contains U.S. Pat. No. 3,981,003 issued Sep. 14, 1976 to Huguenin for a Digital Display Device; U.S. Pat. No. 3,793,629 issued Feb. 19, 1974 to Sharpless for Electrical Display Devices; U.S. Pat. No. 4,039,890 issued Aug. 2, 1977 to Bailey et al for "Integrated Semiconductor Light-Emitting Display Array"; U.S. Pat. No. design 308, 829 issued Jun. 26, 1990 to Gaultier for Digital Clock; and U.S. Pat. No. design 301,014 issued May 9, 1989 to Houlihan for Stopwatch. Huguenin teaches making up the digits of a conventional display of digits, from two portions of which one is constant. The other is activated from selected straight vertical and horizontal segments. He also teaches that "The feed and control circuits (lighting up and extinguishing) of the display device can be developed in any known manner."

Sharpless shows a matrix of light emitting elements arranged in rows and columns, and an addressing arrangement therefor. Bailey et al to show a matrix of light emitting elements and an addressing arrangement therefor, and discusses a variety of devices for non-permanent presentation of information, including cathode ray tubes, plasma discharge displays, and light emitting diodes (LEDs).

Gaultier shows ornaments designed for a digital clock which repeats digits in various places on the clock surface. Houlihan shows an ornamental design for a stopwatch on which different numbers are digitaly displayed by LEDs in a columnar pattern.

SUMMARY OF THE INVENTION

Accordingly, it is an object of the invention to make the digital display of information more interesting.

Another object of the invention is to provide a display which communicates information in a more attractive way.

Still another object of the invention is to provide a display whose information is readily discernable by the cognizenti, but not so by those who are not familiar with its principles.

According to the invention, symbols are manifested by selectively dimming elements of a pair of two boxes (enclosed surfaces) having a common border element to leave illuminated the elements defining the symbol. Pairs of two boxes may be concatenated to form a chain in which the same elements are dimmed in each pair and constitute a continuous pattern wherein the symbols are displayed two or more times in repeating fashion. Chains of pairs of boxes may be placed side by side to set forth simultaneously a plurality of symbols such as the digits which would reflect the time of day. The spaces between the chains may have different shadings or color in order to provide even more attractive designs In a preferred embodiment, the boxes are squares and arranged vertically to form columns.

The invention may be emobodied in hardware or software or both. Thus in a watch, the elements may be normally lit light emitting diodes of which selected ones are dimmed by electronic circuits to leave the lit ones indicating particular digits. On a computer screen, the symbols may be generated through a computer program or TV signal. On a sign, selected neon tubes may be lit through manual switches.

BRIEF DESCRIPTION OF DRAWINGS OF PREFERRED INVENTION EMBODIMENTS

These and other objects, features and advantages of the invention will become apparent from a reading of the following description of preferred embodiments of the invention when considered with the appended drawings wherein.

DETAILED DESCRIPTION OF PREFERRED INVENTION EMBODIMENTS

Figure 1:
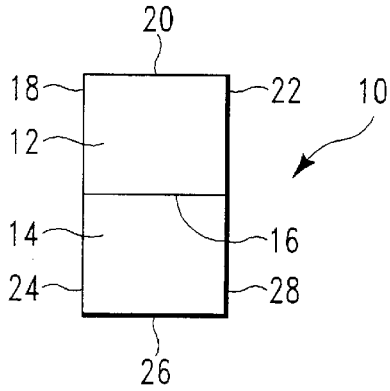
FIG. 1 is a schematic diagram of set of two vertically juxtaposed square boxes sharing a common border element and whose border elements may be selectively dimmed to depict desired symbols such as a time digit of a watch.

Referring now more particulary to the drawings, there is shown schematically in FIG. 1 a diagram of set generally indicated by the numeral 10 of two vertically juxtaposed square boxes 12 and 14 sharing a common border element 16 and whose respective left, other horizontal, and right border elements 18, 20 and 22, and 24, 26, and 28 may be selectively omitted if printed or dimmed if involving light emitting devices to depict desired symbols such as a digit. Thus each of the border elements 16 through 28 may be selectivly omitted or dimmed simultaneously to allow the remaining border elements to indicate a digit.

Figure 2:
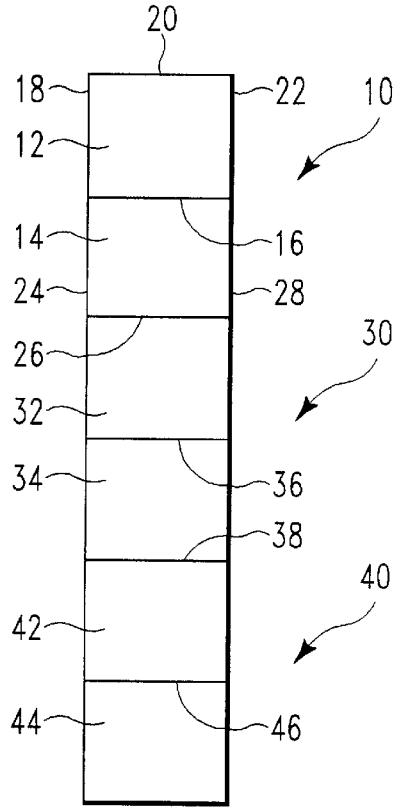
FIG. 2 is a schematic diagram of a column of two vertically juxtaposed sets of boxes of FIG. 1, the upper box of the lower set sharing a common border with the lower box of the upper set.

A concatenated string of sets of boxes is shown in FIG. 2. Thus a second set generally indicated by the numeral 30 of two vertically juxtaposed boxes 32 and 34 sharing a common border element 36, is shown below the set 10 and has its upper box 32 share the lower horizontal border element 26 of the bottom box 14 of the upper set 10. The bottom box 34 has a lower border labeled 38.

A third set generally indicated by the numeral 40 of two vertically juxtaposed boxes 42 and 44 sharing a common border element 46, is shown below the set 30 and has its upper box 42 share the lower horizontal border element 38 of the bottom box 34 of the second set 30. Now when the same digit is indicated in each set of boxes, the appearance will be as shown in four continuous columns in FIG. 4 where the columns respectively and repeatedly indicate the numbers 1, 2, 5, and 2. It is to be noted that corresponding border elements are omitted or dimmed in each set of boxes, and that the digit displayed in each set of boxes in a column utilizes a portion of the display of the box above and/or below it: that is the common border element between each set of boxes serves a dual use. It is also to be observed that a continuous, interlocking character pattern is displayed in each column: thus the bottom horizontal bar of a higher "2" digit forms the top horizontal bar of the next lower "2" digit.

Figure 4:
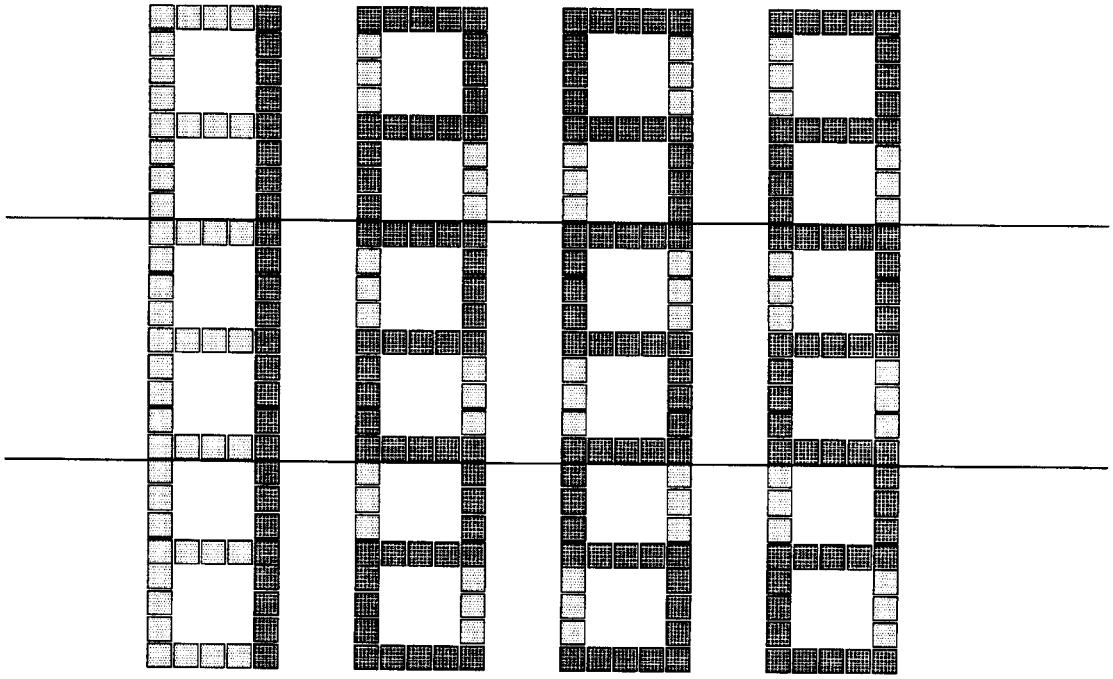
FIG. 4 is a duplicate of the schematic diagram of FIG. 3, but with certain border elements in each column dimmed to show three rows of the time 12:52.

Many different patterns are achieved on the face of a watch indicating times digitally with a plurality of columns such as the set of four depicted in FIG. 4.

Figure 5:
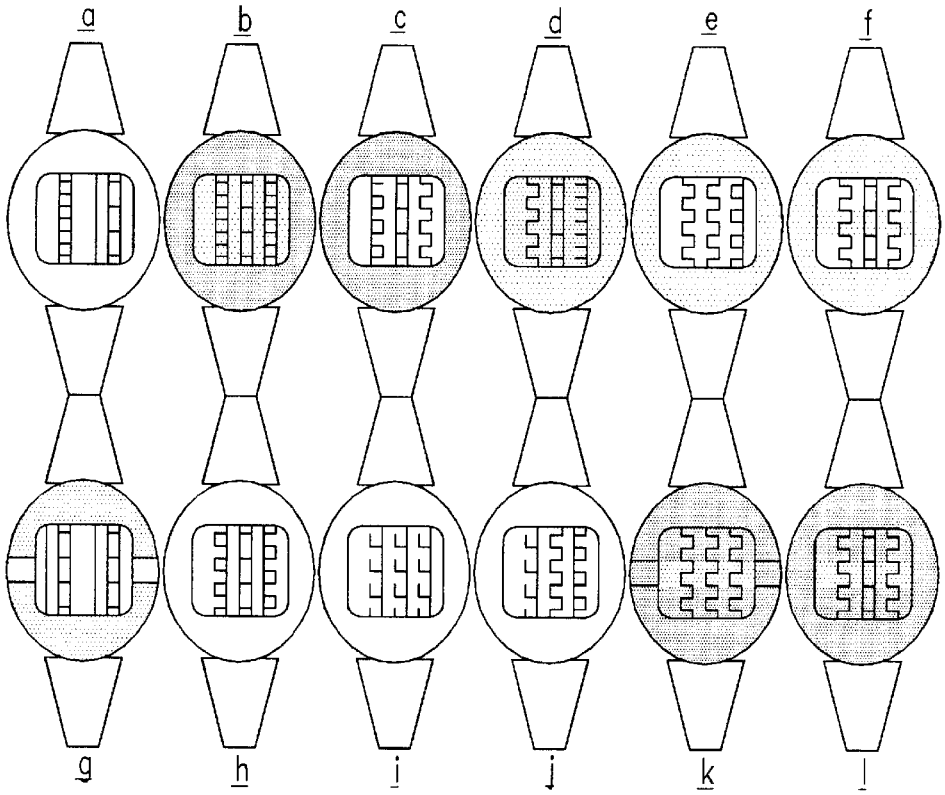
FIG. 5 is a schematic diagram of two rows of watches showing different patterns that can be displayed on watch faces.

FIG. 5 shows twelve watches "a" through "l" respectively setting forth various times. Watch "a" shows time "8:10; "b" shows "8:08"; "c" shows "6:02"; "d" shows "2:03"; "e" shows "2:59"; "f" shows "2:05"; "g" shows "10:10"; "h" shows "9:06"; "i" shows "4:44"; "j" shows "4:56"; "k" shows "2:22"; and "l" shows "5:02".

Figure 6:
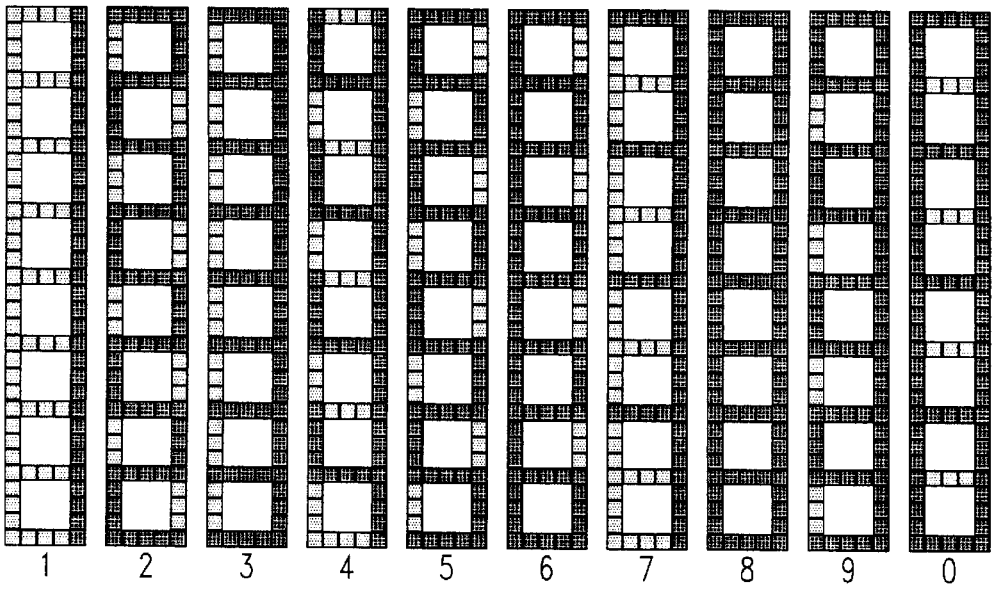
FIG. 6 is a schematic diagram showing the border elements which would be dimmed for the different digits "1 through 0"

FIG. 6 shows ten columns, one for each of the digits "1" through "0".

While a uniform and generally lighter background may be provided for the characters depicted as in FIGS. 4–6, other backgrounds may be employed in the spaces between the continuously repeated digits to impact readability and create desired ornamental effects. Different shadings that might be employed between the displayed elements of the four columns of sets of boxes repeating the time 12:52, might be as set forth in the schematic diagram of FIG. 7. Therein a dark shading 48 surrounds the "1" and extends from the left edge of the face to the continuous outline of the "2" of "12"; a light shading 50 occupies the space between that "2" and the "5"; an intermediate shading 52 occupies the space tetwen the "5" and the other "2"; and the dark shading 48 occupies the space between the latter "2" and the right edge of the face of the display.

Figure 7:
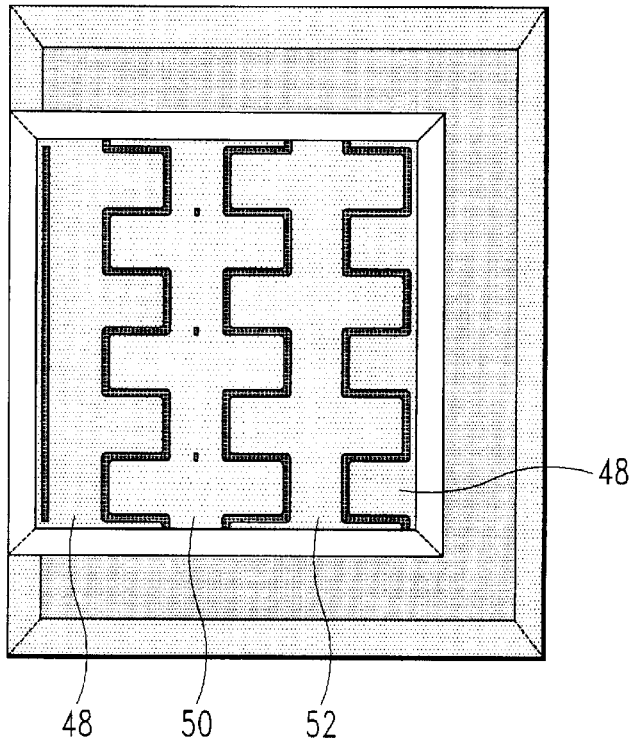
FIG. 7 is a schematic diagram showing different shadings that might be employed between the illuminated elements of four columns of sets of boxes repeating the time 12:52.

Markings such as the dots 54 employed in the bottom of the spaces between the middle digits of the four across in FIG. 7, may be used to facilitate recognition of the rows of digits.

Figure 8:
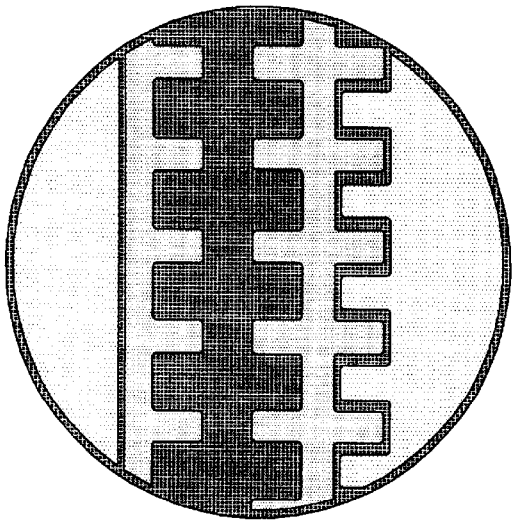
FIG. 8 is a schematic diagram showing another way of shading the space between the illuminated elements of four columns of sets of boxes repeating the time 12:52.
Figure 9:
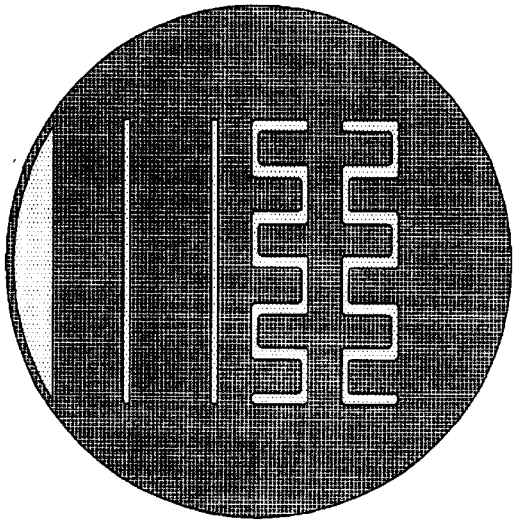
FIG. 9 is a schematic diagram showing still another approach to shading the space between the illuminated elements of four columns of sets of boxes, repeating however this time the time 11:52; such shading might be used to distinguish PM time from AM time.

Other shading arrangements are shown involving the same digits "12:52" in FIG. 8, and the different digits "11:52" in FIG. 9.

Figure 10:
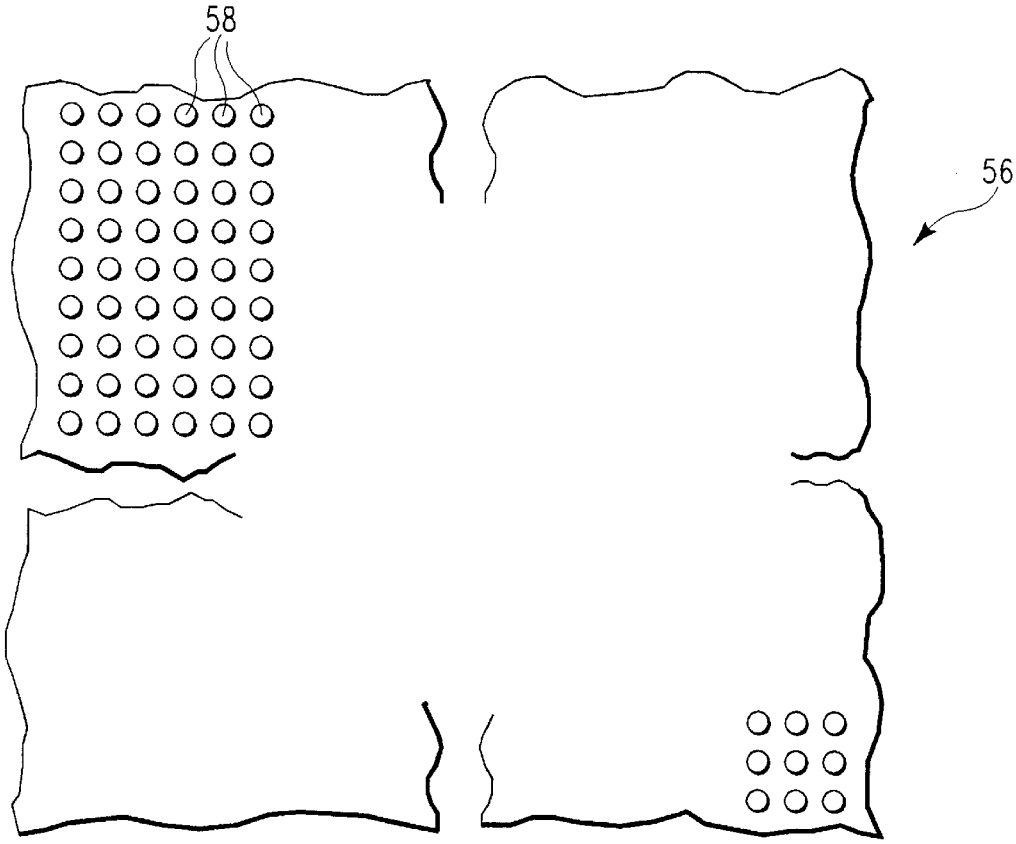
FIG. 10 is a fragmentary diagrammatic front view depicting light emitting elements of an electrical display device.
Figure 3:
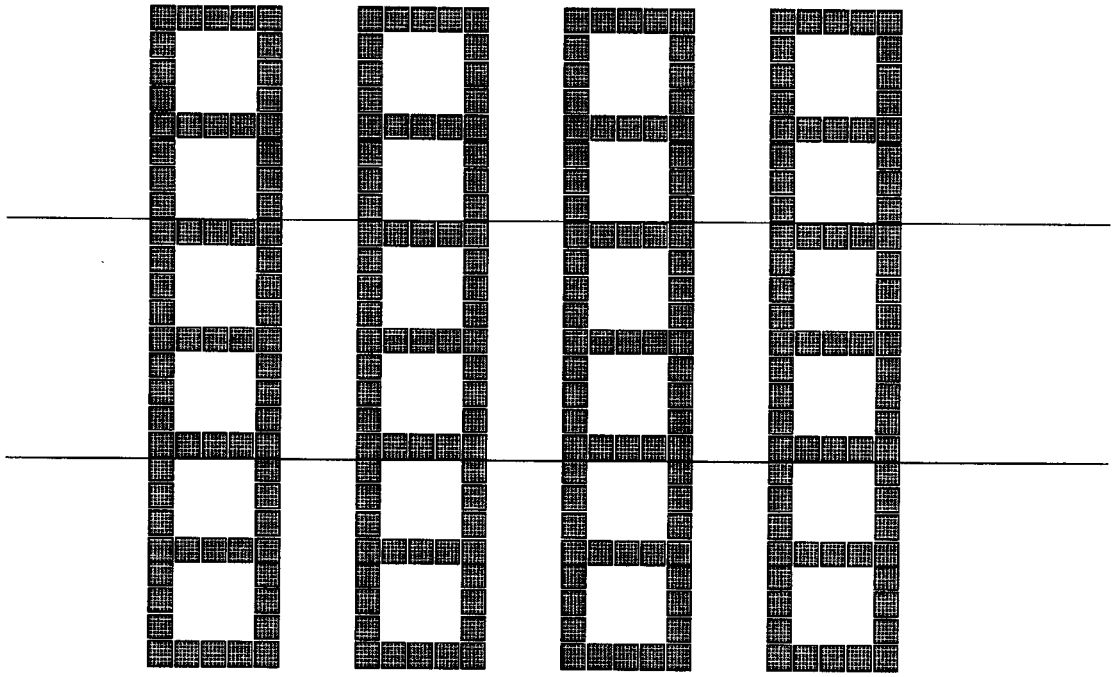
FIG. 3 is a schematic diagram of four columns of the vertically disposed sets of boxes of FIG. 2, each column having been lengthened by a third set of two vertically juxtaposed set of boxes of FIG. 1, the upper box of the bottom set sharing a common border with the lower box of the middle set.

An electrical display device, generally indicated by the numeral 56, employing individual light emiting elements 58 arranged in rows and columns of a matrix, is shown in the fragmentary diagrammatic front view of FIG. 10. The light emitting elements may be light emitting diodes (LCDs) or glow discharge cells. Proper electrical control of the elements allows vertical columns of a desired width, e.g. four elements, to be indicated in the matrix. Four spaced columns might be selected for a watch face.

Figure 12:
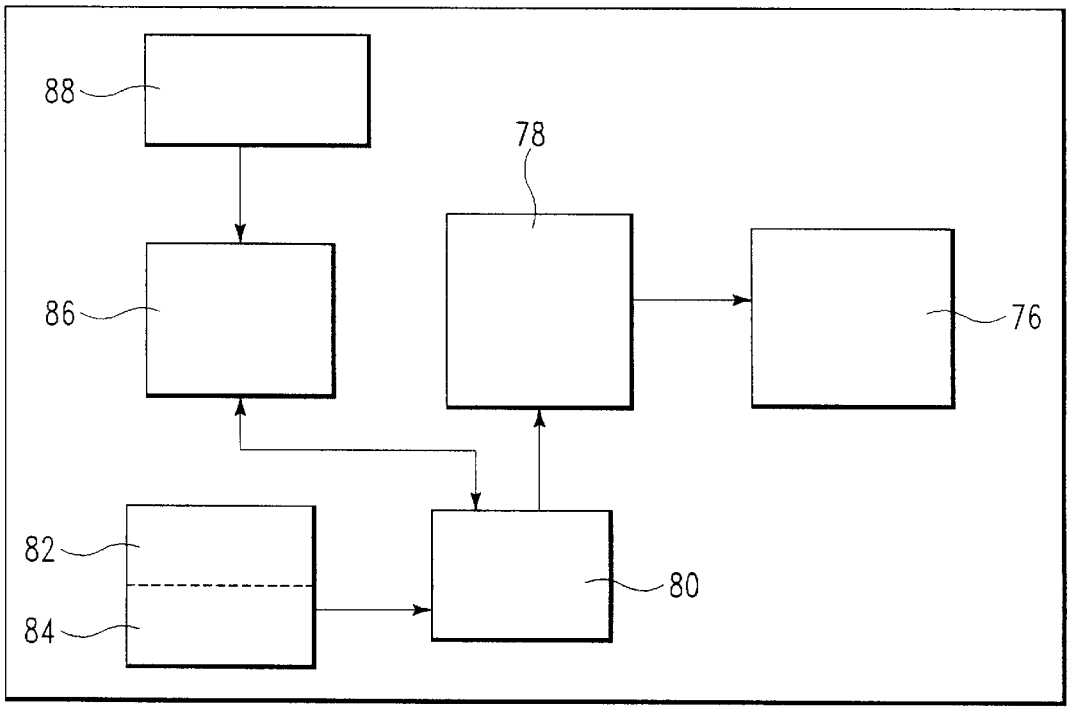
FIG. 12 is a block schematic diagram of a computer employing the invention via a computer program.

A block schematic diagram of a digital watch embodying the display device 56 of FIG. 10 for displaying the pattern of digits of FIG. 4, is shown in FIG. 12. Wiring 60 for each of the five columns of light emitting devices for the selected four separated digit columns to depict the four time-indicating digits of a typical watch, connects a conventional decoder and driver 62 to them. The decoder and driver 62 is connected by four wires 64, one for each of the digit places in a conventional digital time manifestation, to the conventional digital-time-signal-generating component 66 of a watch.

As is well known, a light emitting device in a column is lit by generating a concurrent signal in the row in which it is mounted Thus the rows of the display device 56 are connected by wires 68 to a conventional driver 70 having an upper portion for eight row wires 68, and intermediate portion for nine row wires 68, and a lower portion for eight wires 68: the pulsing of the various wires being appropriately arranged and corrdinated for in conventional fashion. It will be observed from a consideration of FIG. 4, that while each digit is manifested using nine vertically displaced components or pixels in five columns of light emitting devices, and for which corresponding rows obtain in the matrix of the display device 56, the ninth or bottom pixel of an upper digit manifestation also constitutes the first or upper pixel of the repetition of the digit manifestation below it.

Figure 11:
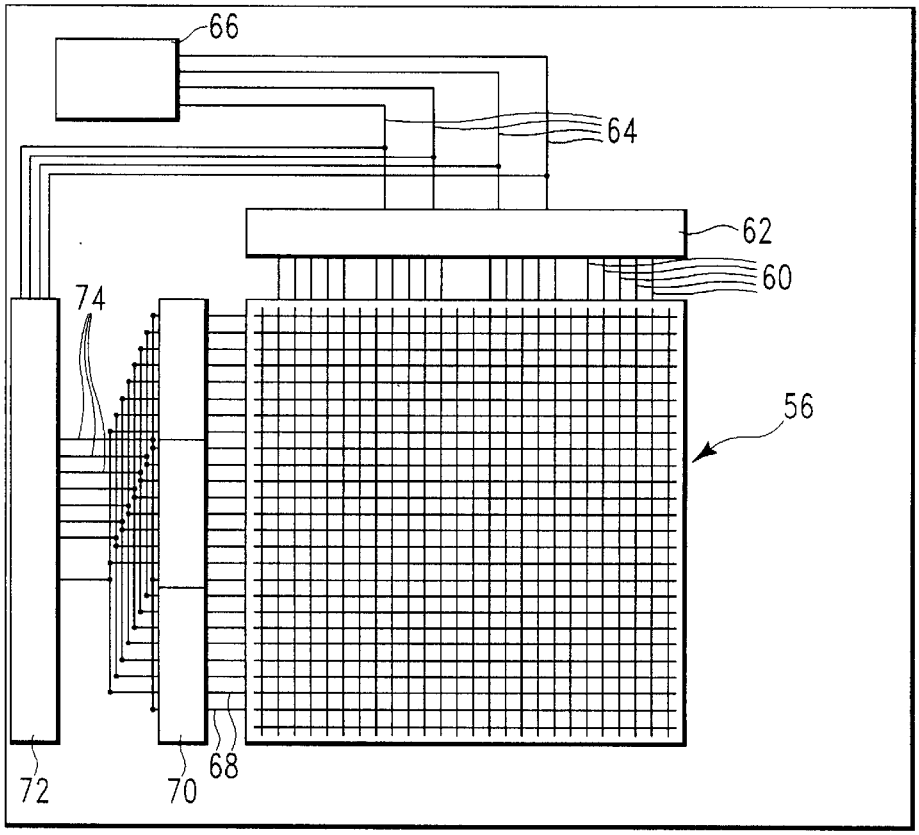
FIG. 11 is a block schematic diagram of a digital watch constructed according to the invention.

In the embodiment shown in FIG. 11, the rows for the eight upper pixels of the upper digit manifestation are driven by the upper portion of the driver 70, the ninth or bottom pixel row not being driven by it. The ninth or bottom pixel row, which also is the top or first row of the same digit manifestation below the upper digit manifestation, is driven through one of the nine wires 68 for the intermediate portion of the driver 70. The rows for the remaining eight pixels of the second or intermediate digit manifestation are driven by the other ones of the nine wirees 68 for the intermediate portion of the driver 70.

The top pixel row of the bottom or third manifestation of the same digit, is the ninth or bottom pixel row of the second or intermediate manifestation of the digit. This leaves the remaining eight pixel rows to be driven through the eight wires 68 connected to the lower portion of the driver 70.

The three portions of the driver 70 are connected to a conventional decoder 72 by eight wires 74. One wire 74 (the upper one) provides the signal to the driver 70 wire for the upper pixel row of each row of digits, and for the bottom pixel row of the bottom digit row. The other seven wires 74 provide the signals to the driver 70 wires for the respective lower-from-the-top pixel rows of each row of digits. Decoder 72 would be connected too by the wires 64 to the conventional digital-time-signal-generating component 66 of a watch.

It should be observed that for the digits "2", "3", "5", "6" "8", and "0", the upper pixel row of the next lower character manifestation serves to complete the manifestation in the preceding digit row.

The invention may also be employed in a computer having a raster display. A block schematic diagram of a computer employing the invention via a computer program is set forth in FIG. 12. A conventional raster display 76 is connected to a conventional display control 78 run by a conventional processor 80 working with a memory 82 which records the computer program 84 by which the processor is directed to periodically sample the presented information in the time indicator stepped along by the computer clock 88. The program contains instructions for how the processor is to run the display control to reflect the time sensed. Sampling is sufficiently frequent to allow manifestations of the time on a current basis.

A computer program according to the invention is set forth in the listing constituting the Appendix. The program of that listing, entitled "Time Line" is written in "Turbo Pascal", and is protected by copyright. It includes the capability of providing the digit lines in color; also the spaces between the columns of the digits.

Characters other than digits, and other symbols, may be employed in the invention. Digits, of course, are the primary symbols used in time manifestations. But other information may be manifested, dependent on the application.

The computer program may also be employed as a screen saver. Screen savers seek to present continually varying patterns to save a raster display from developing burn spots from too long an illumination of a particular display spot. The continuing changing of time results in a varying display that does not irradiate a given display spot too long. The computer may be set to kick in the Timeline program automatically after a selected period of non display use.

While applicant has shown preferred embodiments of the invention, it will be apparent to those skilled in the art that other and different applications may be made of the principles of the invention. It is therefore desired to be limited only by the scope of the claims.

What is claimed is:

1. A display device for a selected symbol formed with a first box having border defining elements, and with a second box having border defining elements, various ones of the elements of each of the two boxes being illumined or darkened to define jointly the symbol, wherein the boxes are juxtaposed and share a common border element, wherein the first box and the second box constitute a first set of two boxes, and wherein another set of two boxes having border defining elements is formed in line with the first two boxes and a box from each shares a common border element, various ones of the elements of each of the two boxes of the second set being illumined or darkened to define jointly the selected symbol too.

2. A display device according to claim 1, wherein ones of the elements in the another set of two boxes corresponding to the elements of the two boxes being illumined or darkened are illumined or darkened too.

3. A display device according to claim 1, wherein still another set of two boxes is formed in line with the two sets of boxes and has a box sharing a common border with a box of the another set.

4. A display device according to claim 3, wherein ones of the elements in the another set and in still another set of two boxes corresponding to the elements of the two boxes being illumined or darkened, are illumined or darkened too and form a continuous columnar pattern.

5. A repeated same-digit display sharing common border elements of the digit, comprising a first display of the digit, and a second display of the digit, the same digits being disposed one above the other, the digit above sharing its lower border element with the upper border element of the digit below.

6. A repeated same-digit display sharing common border elements of the digit according to claim 5, wherein the first display is the upper one and the second display is the lower one and the border component of the first digit is its lower one and the opposite border component of the second is its upper one.

7. A repeated same-digit display sharing common border elements of the digit according to claim 6, and a third display of the digit, the lower border component of the second digit constituting the upper border component of the third.

8. A repeated same-digit display sharing common border elements of the digit according to claim 5, wherein the digit border elements are of a rectangular outline.

9. A repeated same-digit display sharing common border elements of the digit according to claim 8, wherein the digit may be any of the numbers "2", "3", "5", "6", "8" and "0".

10. A repeated same-digit display sharing common border elements of the digit according to claim 5, wherein the digit is any of a number, character, or symbol.

11. An apparatus displaying the time in repeated rows of digits juxtaposed to each other, the digits having border defining elements, the same digits being disposed one above the other and sharing common border elements.

12. In an apparatus displaying the time in juxtaposed repeated rows according to claim 11, wherein the digit in the second row is below the same digit in the previous row.

13. In an apparatus displaying the time in juxtaposed repeated rows according to claim 12, and another juxtaposed repeated row wherein the digit in the another repeated row is below the same digit in the second row.

14. In an apparatus displaying the time in juxtaposed repeated rows according to claim 12, wherein the border component of the bottom of the digit in the row is shared with the border component of the top of the digits in the second row.

15. In an apparatus displaying the time in juxtaposed repeated rows according to claim 12, wherein the apparatus is a watch having a light emitting device display, and the watch generates signals for several digits representing current time, and the digits are manifested in each row of the display, the same digits in each row forming a continuous columnar pattern spaced from the columnar pattern of an adjacent digit.

16. In an apparatus displaying the time in juxtaposed repeated rows according to claim 12, wherein the apparatus is a computer having a raster display and a computer program, and the computer generates signals for several digits representing current time, and the computer program is periodically exercised to cause the raster display to manifest the time in each row of the display, the same digits in each row forming a continuous columnar pattern spaced from the columnar pattern of an adjacent digit.

* * * * *